US005732885A

United States Patent [19]

Huffman

[11] Patent Number: 5,732,885

[45] Date of Patent: Mar. 31, 1998

[54] INTERNAL MIX AIR ATOMIZING SPRAY NOZZLE

[75] Inventor: David C. Huffman, Merrimack, N.H.

[73] Assignee: Spraying Systems Co., Wheaton, Ill.

[21] Appl. No.: 495,831

[22] Filed: Jun. 28, 1995

Related U.S. Application Data

[63] Continuation-in-part of Ser. No. 319,990, Oct. 7, 1994, abandoned.

[51] Int. Cl.[6] ..... B05B 7/04

[52] U.S. Cl. ..... 239/416.5; 239/432; 239/548

[58] Field of Search ..... 239/423, 424, 239/432, 416.5, 417.3, 416.4, 548

[56] References Cited

U.S. PATENT DOCUMENTS

| | | | |
|---|---|---|---|
| 788,764 | 5/1905 | Fitton | 239/432 |
| 1,209,566 | 12/1916 | Discher | 239/432 |
| 1,428,896 | 9/1922 | McDonald et al. | 239/432 |
| 1,446,746 | 2/1923 | Hoxie | 239/432 |
| 1,901,806 | 3/1933 | Fulton | 239/432 |
| 1,999,121 | 4/1935 | Wilson | 158/75 |
| 3,164,446 | 1/1965 | Drechsel et al. | 23/288 |
| 3,385,527 | 5/1968 | Drewry | 239/424 |
| 3,929,290 | 12/1975 | Tallarovic | 239/417.3 |
| 3,961,475 | 6/1976 | Wood | 60/39.65 |
| 4,828,181 | 5/1989 | Singels-Craenen | 239/405 |
| 4,846,405 | 7/1989 | Zimmermann | 239/422 |
| 4,982,716 | 1/1991 | Takeda et al. | 123/531 |
| 5,289,976 | 3/1994 | Dou et al. | 239/431 |

FOREIGN PATENT DOCUMENTS

| | | | |
|---|---|---|---|
| 62-186112 | 8/1987 | Japan . | |
| 027475 | 7/1983 | U.S.S.R. | 239/432 |

*Primary Examiner*—Kevin Weldon

*Attorney, Agent, or Firm*—Leydig, Voit & Mayer, Ltd.

[57] ABSTRACT

The nozzle effects three stages of liquid atomization. The first stage is carried out by means of a single liquid orifice and an expansion chamber containing an impingement pin. A high velocity stream of liquid is discharged through the liquid orifice and is broken-up upon striking the flat end of the impingement pin. The second stage is produced by an air guide which reduces in area to form jets of air into a high velocity annular air curtain, the curtain passing through the liquid orifice in surrounding relation with the liquid stream and striking the broken-up flow of the first stage to atomize the particles. The mixture is then allowed to expand in the expansion chamber to reduce the tendency of the liquid particles in the atomized mixture from commingling together and reforming into larger particles. The third stage is effected by the expansion chamber and by multiple discharge orifices. The mixture is sprayed from the expansion chamber through the multiple orifices and, upon being discharged into the atmosphere, the particles are atomized further due to the release of pressure formed inside the expansion chamber.

32 Claims, 5 Drawing Sheets

INTERNAL MIX AIR ATOMIZING SPRAY NOZZLE

This is a continuation-in-part of my application Ser. No. 08/319,990 filed Oct. 7, 1994, now abandoned and which is incorporated herein by reference.

BACKGROUND OF THE INVENTION

This invention relates generally to a nozzle for atomizing and spraying liquid and, more particularly, to a nozzle of the type in which the liquid is atomized by pressurized air which is mixed with the liquid internally of the nozzle.

Internal mix air atomizing nozzles are known. Many of such nozzles, however, are not capable of effecting extremely fine atomization of the liquid when the liquid is supplied to the nozzle at a high flow rate.

The term "nozzle" is used herein in the sense of the overall atomizing dispenser device or assembly.

SUMMARY OF THE INVENTION

The general aim of the present invention is to provide an internal mix atomizing nozzle which effects atomization of the liquid in multiple stages so as to enable the nozzle to discharge a finely atomized spray at high flow rates.

A more detailed object of the invention is to provide a nozzle of the above character which mechanically atomizes the liquid, effects further atomization by means of a high velocity air stream, and then produces even finer atomization as an incident to spraying the liquid into the atmosphere.

The invention also resides in a unique nozzle construction which reduces the tendency of atomized liquid particles to commingle together and reform into larger particles prior to discharge of the particles into the atmosphere.

Another object is to provide such a nozzle which facilitates variation in flow rate of the liquid being atomized over a wide range.

A more specific object is to permit variation of the liquid flow rate by varying the liquid feed pressure over a wide range without changing the input air pressure.

A further object is to provide such an atomizing nozzle which is easy to manufacture, even when using materials that are difficult to bore and machine, such as various materials which are highly resistant to corrosion and wear.

These and other objects and advantages of the invention will become more apparent from the following detailed description when taken in conjunction with the accompanying drawings.

Figure 1:
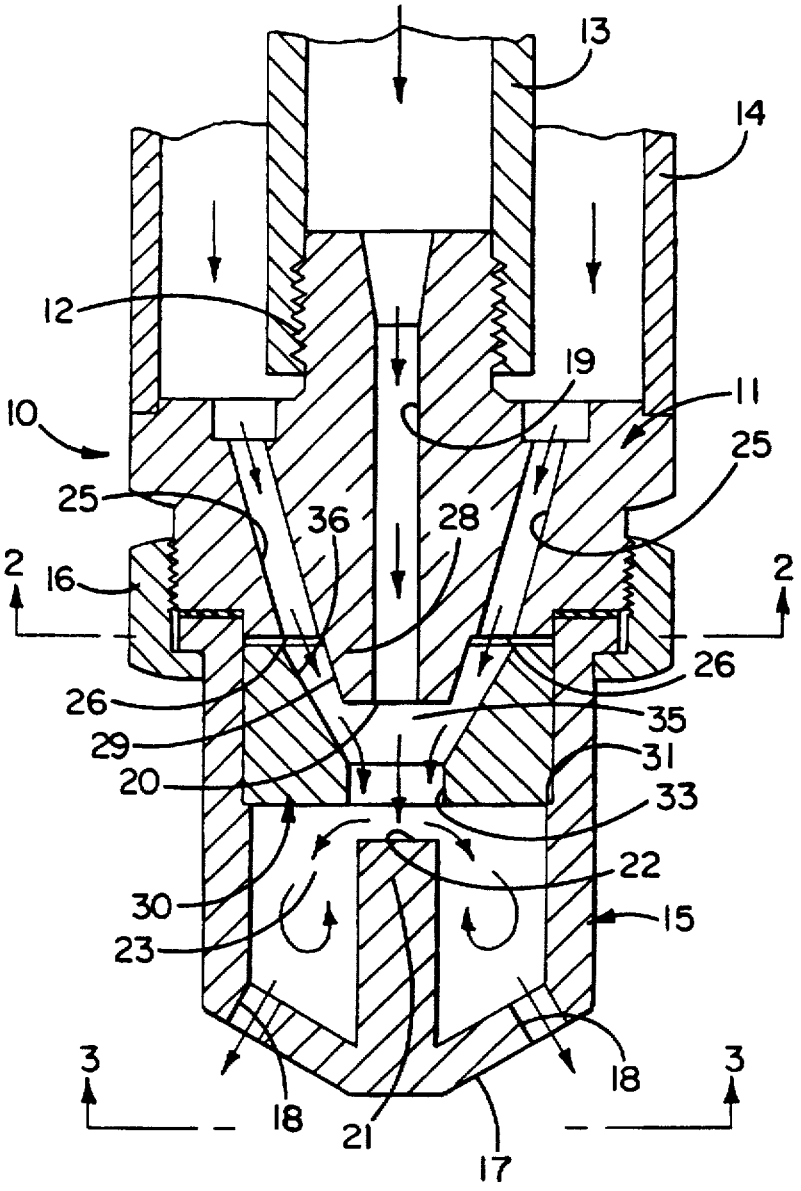
FIG. 1 is a cross-sectional view taken axially through a new and improved atomizing nozzle incorporating unique features of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE ILLUSTRATED EMBODIMENTS

Figure 2:
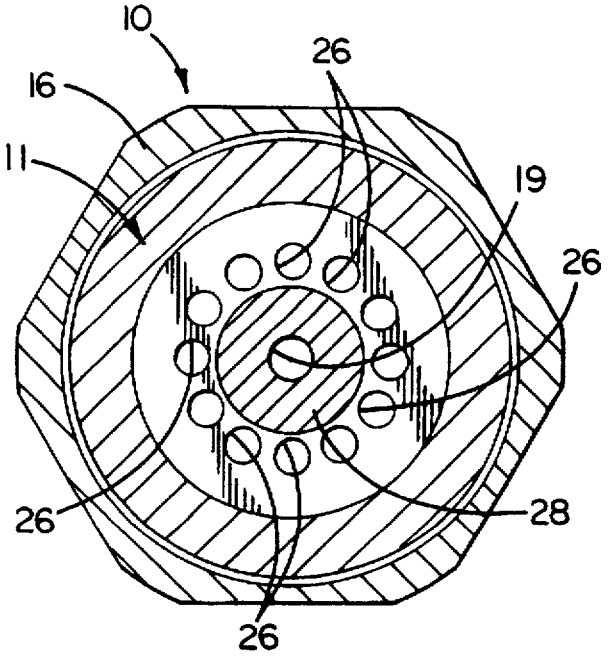
FIG. 2 is a cross-section taken substantially along the line 2—2 of FIG. 1.
Figure 3:
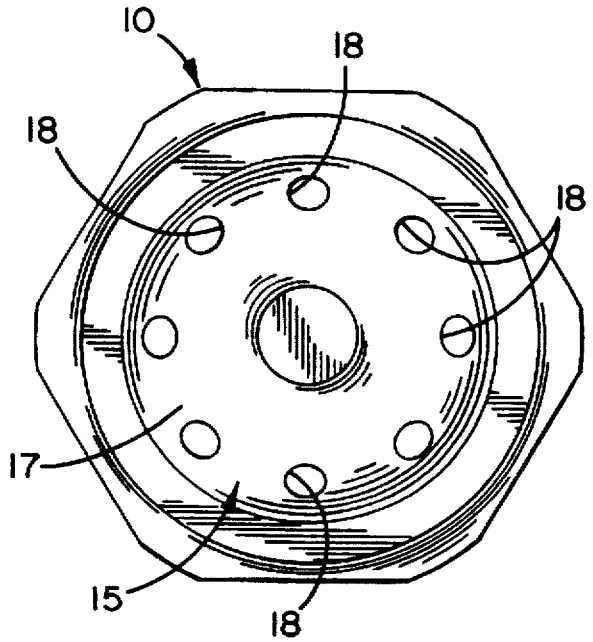
FIG. 3 is an end view of the nozzle as seen along the line 3—3 of FIG. 1.

As shown in FIGS. 1–3 of the drawings for purposes of illustration, the invention is embodied in a nozzle 10 for atomizing a stream of pressurized liquid and for discharging the liquid to atmosphere in the form of a finely divided spray. The nozzle includes a body 11 with an upwardly extending and externally threaded neck 12 which is adapted to be attached to a line 13 for delivering pressurized liquid to the nozzle. A second line 14 of larger diameter is coaxial with the line 13 and is suitably attached to the upper end of the body 11 below the neck 12. Pressurized air is supplied to the nozzle via the line 14.

A nozzle tip 15 is positioned below the body 11 and is removably attached thereto by a coupling nut 16. The lower end 17 of the tip is generally frustoconical and is formed with a plurality (herein, eight) of discharge orifices 18 through which the liquid is sprayed. In this particular instance, these discharge orifices are perpendicular to the frustoconical end 17 of the tip but are angled outwardly relative to the axis of the nozzle 10 by virtue of the inclination of the end.

Liquid introduced into the nozzle 10 is atomized into fine particles prior to being sprayed out of the discharge orifices 18. In accordance with the present invention, the nozzle atomizes the liquid in multiple stages so as to enable extremely fine atomization even when the flow rate through the nozzle is relatively high.

More specifically, the body 11 of the nozzle 10 is formed with a central and axially extending liquid passage 19 which communicates with the line 13 and which terminates as an axially facing discharge orifice 20. Projecting upwardly from the lower end 17 of the tip 15 is an impingement pin 21 having a substantially flat upper end surface 22 disposed in axially spaced and opposing relation with the orifice 20. As illustrated, the end surface 22 is axially aligned with the extended central longitudinal axis of the discharge orifice 20 and is at a right angle to that axis, i.e. being normal to that axis and thus normal to the axis of a jet or stream of liquid discharged from that orifice at substantial velocity.

The pin is located in a chamber 23 of circular cross-section defined within the tip 15. Upon being discharged from the orifice 20 and into the chamber 23, a high velocity stream of liquid strikes the upper end 22 of the pin 21 and is broken up into a thin sheet and/or small particles. Accordingly, the first stage of atomization is effected mechanically by virtue of the liquid striking the pin.

Several (e.g., twelve) angularly spaced air passages 25 are formed through the body and preferably are inclined so as to converge in a downstream direction, i.e. in the direction of flow of the liquid and air through the nozzle 10. At their upper ends, the passages communicate with the air line 14 through an annular manifold recess 38 and thus pressurized air is injected into the passages. The lower ends of the passages define air outlets 26 located upstream of and disposed in encircling relation with the single liquid orifice 20. That portion of the body 11 located downstream of the air outlets 26 defines a nose 28 having a generally frustoconical outer surface 29 which is inclined at approximately the same angle as the passages 25. The liquid discharge orifice 20 opens out of the lower end of the nose 28.

An air guide 30 is located within the tip 15 below the body 11 and contracts the jets of air from the outlets 26 into a tubular curtain which surrounds the liquid stream as the latter impinges against the pin 21. Herein, the air guide 30 is formed by an insert located within the upper end portion of the tip 15 and seated against an upwardly facing shoulder 31 formed around the wall of the chamber 23. The lower end portion of the insert 30 is formed with a cylindrical discharge opening 33 which is located between and is aligned with the orifice 20 and the pin 21. The cross-sectional area of the discharge opening 33 is substantially less than the cross-sectional area of the chamber 23.

Formed in the insert 30 immediately above the discharge opening 33 is a chamber or bore 35 having a generally frustoconical wall 36. The upper end portion of the bore 35 is located immediately adjacent the air outlets 26 and its wall 36 tapers upon progressing downwardly. The air outlets 26 open generally axially into the annular space between the frustoconical surface 29 and the frustoconical wall 36. In this instance, the cone angle of the bore 35 is somewhat greater than the cone angle of the nose 28 and thus the annular space tapers upon progressing downwardly.

With the foregoing arrangement, jets of air shooting from the outlets 26 are formed into an annular curtain by the wall 36 of the bore 35. The air curtain surrounds the stream of liquid discharged from the orifice 20 and, upon entering the discharge opening 33, undergoes a substantial increase in velocity. When the high velocity air emerges from the opening 33, it strikes the liquid particles previously atomized by the pin 21 and thus further atomizes those particles. Accordingly, the particles are subjected to a second stage of atomization which is effected pneumatically by the high velocity air.

The open volume of the chamber 23 is substantial and thus the air/liquid mixture is permitted to expand in the chamber. As a result, there is little tendency for the atomized liquid particles to commingle together and reform into larger particles prior to being sprayed through the orifices 18.

A third stage of atomization occurs as the resulting air/liquid mixture is sprayed from the chamber 23 through the orifices 18. As the mixture is discharged to atmosphere, the liquid particles are atomized even more finely as a result of being released from the pressure in the chamber.

Figure 4:
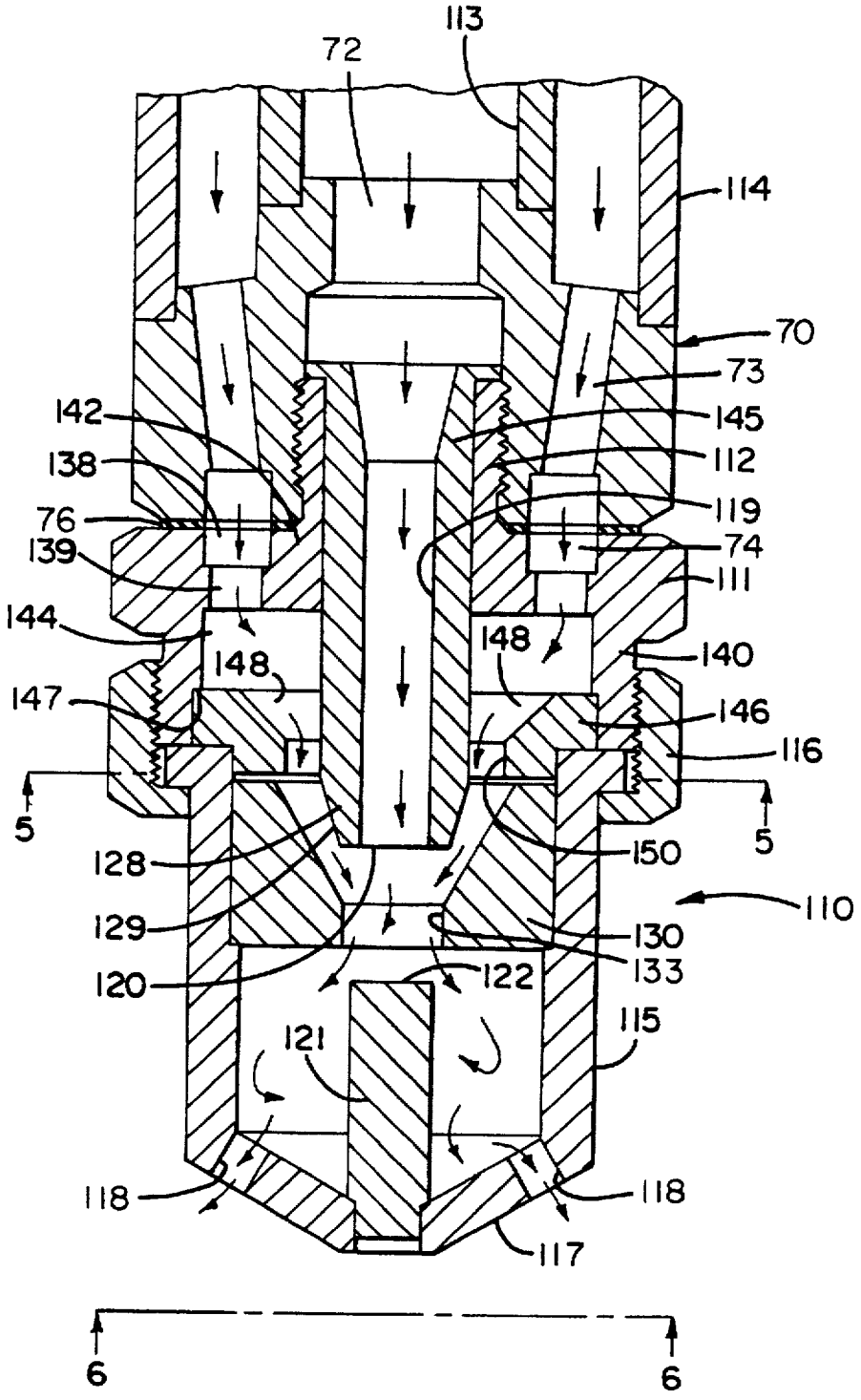
FIG. 4 is a cross-sectional view similar to FIG. 1 of another embodiment incorporating unique features of the present invention.
Figure 5:
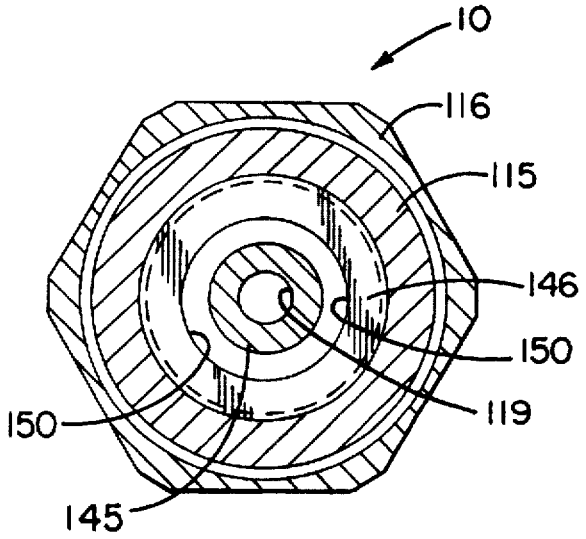
FIG. 5 is a cross-section taken substantially along the line 5—5 of FIG. 4.
Figure 6:
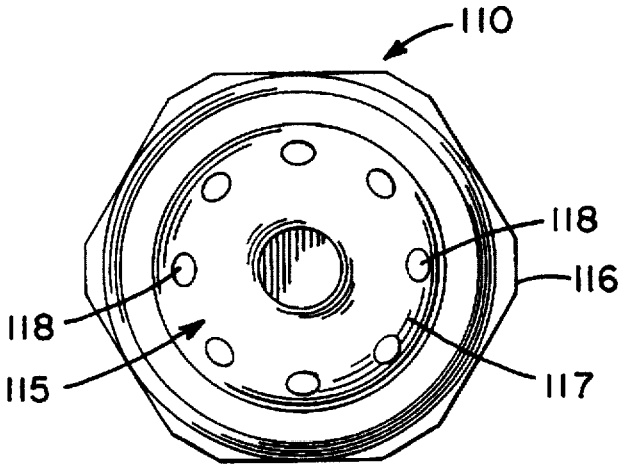
FIG. 6 is an end view of the nozzle of FIG. 4 as seen along the line 6—6 of FIG. 4.

The nozzle 110 illustrated in FIGS. 4–6 is of substantially the same construction and mode of operation as the nozzle 10. Corresponding parts are identified by the same numbers in the 100 series without further discussion, except as may be appropriate to point out correlations and differences. In the main, the nozzle 110 provides an alternative design for conveying the pressurized liquid and air inputs from their supply connections to the air guide 130. In lieu of the one-piece multi-functional body 11 of nozzle 10, the nozzle 110 includes a manifold fluid supply tip body 111 which is of generally hollow cylindrical configuration. Body 111 includes an annular wall 140 which abuts the end of the nozzle tip 115 and has threaded connection with a coupling nut 116 at one end. The opposite end of the fluid supply tip body 111 includes an end wall 142 from which the threaded neck 112 extends. Wall 142 is formed with an annular manifold recess 138 and a plurality of short, straight passages 139 which extend from the manifold recess 138 to the open interior space 144 for passage of the compressed atomizing air from a supply line 114 into the space 144.

The threaded neck 112 extends outward from the wall 142 for threaded connection with the supply line 113 which supplies pressurized liquid. In the embodiment of FIG. 4, both the liquid supply line 113 and the coaxial surrounding air supply line 114 are connected to a common coupler manifold member 70 which threadably engages the neck 112. The member 70 includes a central liquid passage 72 and a ring of air passages 73 which lead to an annular air manifold recess 74. A sealing gasket 76 is disposed between the member 70 and the body 111.

The neck 112 also receives and supports a hollow cylindrical orifice insert 145. The orifice insert 145 includes the tapered nose 128 and a single discharge orifice 120 disposed within the air guide 130.

An annular supply air guide 146 surrounds the insert 145. The guide 146 seats against a shallow shoulder 147 in the body 111 and is held in place by the end flange of the nozzle tip 115 and the coupling nut 116. The guide 146 is formed with an interior frustoconical surface 148 which leads from the upstream end of this guide member 146 to a short cylindrical interior wall 150 which is generally parallel to and spaced from the outer wall of the orifice insert 145. The space 144 between the wall 142 and the air guide 146 serves as a manifold for the air supply between the inlets 138, 139 and the air supply passage defined between the outer surface of the liquid orifice insert 145 and the inner surface of the supply air guide 146.

The impingement pin or pintel 121 preferably is a separate pin element which is secured in position in the nozzle tip 115, as by welding. The same manner of mounting the pintel can be applied to the nozzle 10. Also, the impingement surface 122 may be provided by other structures, such as by a plate disposed across the extended axis of the central liquid passage 19, 119 and supported by narrow radial supports which extend to and are supported on the walls of the expansion chamber defined by the nozzle tip 115.

The nozzle 110 atomizes liquid in substantially the same manner as the nozzle 10. That is, in each of them the liquid jet strikes the impingement surface 22, 122 and thereby is dispersed laterally as a film and/or small particles of water which fan out laterally beyond the impingement surface, moving outward generally normal to the extended axis of the nozzle and hence of the jet. The high pressure air travels at high velocity through the nozzle 10, 110. Its velocity is enhanced by the converging and constricting configurations of the air flow passages through the nozzle. The resulting high velocity air flows essentially parallel to the fluid jet, in an annulus or cylinder about that jet, through the cylindrical discharge opening 33, 133 and to the impingement surface 22, 122 where the air strikes the dispersed liquid on and around the impingement surface 22, 122. In this regard, the discharge opening 33, 133 is somewhat larger in diameter than the circular impingement surface 22, 122. The high velocity air strikes the dispersing liquid around the impingement surface and atomizes the liquid being dispersed from its initial atomizing break-up against the impingement surface 22, 122. The substantial volume of the expansion chamber around and downstream of the impingement surface minimizes the commingling together and attendant reformation of the thus atomized liquid particles into larger particles prior to being sprayed through the discharge orifices 18, 118. This latter spraying further atomizes the liquid.

By way of specific examples, nozzles of constructions as illustrated in respect to nozzles 10 and 110 have provided good operating results with the following relative dimensions:

| | I | II | III |
|---|---|---|---|
| Liquid Passage (19, 119), Diameter | 0.219" | 0.328" | 0.437" |
| Discharge Opening (33, 133), Diameter | 0.468" | 0.468" | 0.625" |
| Impingement Surface (22, 122), Diameter | 0.375" | 0.375" | 0.500" |
| Diameter of Expansion Chamber (I.D. of nozzle tip (15, 115)) | 1.438" | 1.438" | 1.438" |
| Depth of Expansion Chamber (from air guide (30, 130) to outer perimeter of truncated conical end (17, 117)) | 0.859" | 0.859" | 0.859" |
| Internal angle of conical end (17, 177) | 120° | 120° | 120° |
| Eight Discharge Orifices (18, 118), Diameter of each | 0.187" | 0.187" | 0.187" |

From the foregoing, it will be apparent that the present invention brings to the art a new and improved spray nozzle in which the liquid is subjected to three stages of atomization as an incident to passing through the nozzle. Because the liquid is so thoroughly atomized, the nozzle is capable of producing a finely atomized spray even when the flow rate through the nozzle is large. Further, the improved nozzle provides a high degree of atomization over a wide range of flow rates of the liquid being atomized. It permits varying the liquid flow rate by varying the liquid flow feed pressure over a wide range without changing the input air pressure. The liquid pressure may even be much lower than the air pressure, providing a large "turn-down" ratio.

Nozzles of the subject type often are used in environments which are highly corrosive such as in the gas cooling of combustion gasses, including use in incinerating of hazardous waste, or in highly abrasive circumstances such as in spraying a lime slurry to cool and neutralize sulfur dioxide. For such uses, often it is desirable or necessary that the nozzles be made of materials that are difficult to machine. For example, materials which will provide substantial useful lives for nozzles in such environments include high nickel and chromium steels such as Hastelloy® C-276 of Hanes International, of Winsor, Conn., for corrosion resistance; "Stellite" of Stoody Deloro Stellite Incorporated, or reaction bonded silicone carbides for use in highly abrasive environments; or certain stainless steel formulations such as 316 stainless steel. Accurately forming a relative complex component from such materials presents certain manufacturing difficulties and costs, particularly in making nozzles having long internal passages of relatively small diameters. For such reasons, the embodiment illustrated in FIGS. 4–6 presently is preferred.

Figure 7:
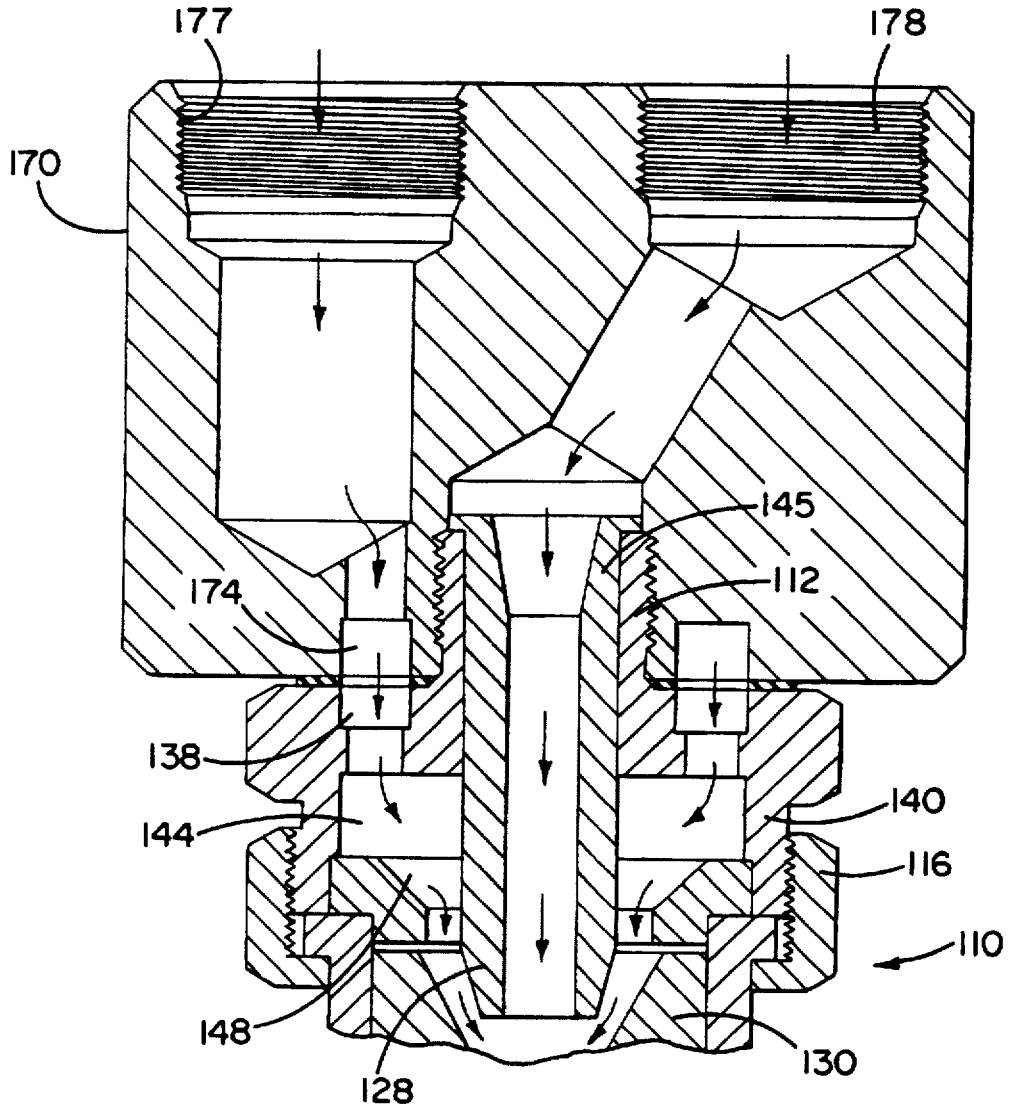
FIG. 7 is a partial view similar to FIG. 4 with another supply connection.

The coupler manifold arrangement of FIG. 4 for connecting the concentric air and liquid supply lines to the nozzle also may be used with the nozzle embodiment of FIGS. 1–3. FIG. 7 illustrates an alternative mode of connection of the liquid and air supply lines, which is applicable to either nozzle 10 or 110 when separate non-concentric supply lines are used. Here a coupler manifold member 170 includes a threaded socket 177 for connection of a high pressure air line. This socket 177 is connected to an annular manifold recess 174 which essentially matches the manifold 38, 138 of the mating nozzle 10, 110. A second threaded socket 178 couples with a controlled pressure liquid supply line and is in sealed communication with the outer end of the central liquid passage 19, 119 when the coupler 170 is affixed to the respective nozzle 10, 110.

A separate liquid orifice insert similar to the insert 145 of the embodiment of FIG. 4 also could be used in a nozzle having a body with multiple air supply passages such as the passages 25 in the embodiment of FIG. 1.

From the foregoing it can be seen that improved nozzles and related methods of atomization have been provided which accomplish the objects of this invention.

The invention has been described in detail with particular reference to certain preferred embodiments and various specific alternatives, and the operation thereof. However, it will be understood that other variations, modifications and the substitution of equivalent mechanisms can be affected within the spirit and scope of this invention, particularly in light of the foregoing teachings. It is contemplated by the following claims to cover any such modifications and other embodiment that incorporate those features which constitute the essential features of the invention with the true spirit and scope of the following claims.

I claim:

1. A nozzle for atomizing and spraying liquid into the atmosphere, said nozzle comprising a body having a liquid passage which terminates in a single discharge orifice, an impingement pin having a generally flat end disposed in spaced opposing relation with said orifice whereby a jet of pressurized liquid discharged through said orifice strikes the end of said pin and breaks up into a dispersed flow of the liquid, an air supply for discharging air around said discharge orifice whereby pressurized air discharged therefrom forms an annular curtain of air around said liquid jet, an air guide located between said air supply and said impingement pin for contracting said air curtain and increasing the velocity thereof whereby said curtain of air will strike and further atomize such a dispersed flow of the liquid into atomized particles, said air guide having a discharge opening through which said stream and said curtain pass before said stream strikes said pin, an expansion chamber located downstream of and communicating with said discharge opening, said chamber extending around said end of said impingement pin and having a cross-sectional area substantially greater than the cross-sectional area of said discharge opening and said pin whereby the fluid discharged through said opening expands in said chamber to restrict such atomized particles from commingling together and reforming into larger particles, and angularly spaced orifices located about said pin and communicating directly between said chamber and ambient atmosphere to discharge such particles from said chamber and effect further atomization thereof.

2. The invention as in claim 1 wherein said body defines air passages having outlets spaced angularly around said discharge orifice for providing said annular curtain of air.

3. The invention as in claim 2 in which said air passages are inclined so as to converge toward said single discharge orifice and centrally within said air guide.

4. The invention as in claim 1 in which air supply is located upstream of said single discharge orifice.

5. The invention as in claim 4 in which said body includes an end portion from which said single discharge orifice opens axially, said end portion having a generally frustoconical outer surface which tapers inwardly upon progressing toward said single discharge orifice, said air guide including a chamber with a generally frustoconical wall which tapers inwardly upon progressing axially toward said discharge opening.

6. The invention as in claim 5 in which a portion of said frustoconical wall upstream of said single discharge orifice encircles a portion of said frustoconical surface in radially spaced relation thereto, said air supply opening generally axially into the space between said frustoconical wall and said frustoconical surface.

7. The invention as in claim 6 in which the cone angle of said frustoconical wall is greater than the cone angle of said frustoconical surface.

8. The invention as in claim 1, including a nozzle tip, said impingement pin being supported by said nozzle tip, and said discharge orifices being formed in said nozzle tip circumferentially about said impingement pin.

9. The invention of claim 8, in which said nozzle tip defines said expansion chamber about said impingement pin.

10. An internal mix pneumatic atomizer for atomizing and spraying liquids, said atomizer including a supply member having a liquid flow passage which terminates in a liquid discharge orifice for high velocity discharge of a stream of liquid along a predetermined axis, an impingement element having an impingement surface spaced from said discharge orifice and disposed across said axis for breaking up such a stream of liquid impinging thereon into a laterally spreading dispersion of such liquid which thereby is dispersed laterally of said axis from the impingement of such stream on said impingement surface, one or more air outlet orifices disposed around said axis upstream of said impingement surface and oriented to discharge air in a downstream direction at high velocity around said axis to strike the liquid while in such a laterally spreading dispersion to atomize such dispersed liquid; and a housing which defines an expansion chamber of substantial volume extending around said impingement surface for expansion therein of the mixture of air and atomized liquid resulting from the impingement of such stream on said impingement surface and the striking of such dispersed liquid by such high velocity air, said housing having a plurality of discharge orifices disposed circumferentially about said impingement surface and communicating directly between said expansion chamber and ambient atmosphere through which such expanded mixture is discharged from said chamber and thereby further atomized.

11. The invention as in claim 10 wherein said expansion chamber is of a cross-section greater than about eight times the area of said impingement surface.

12. The invention as in claim 10 wherein said outlet orifice or orifices are oriented to direct the air discharged therefrom substantially parallel to said axis.

13. The invention as in claim 12 including an air guide which defines an internal surface around said axis and which extends downstream from said liquid discharge orifice, said internal surface defining a flow area which decreases in cross-section from said liquid discharge orifice toward said impingement surface for enhancing the velocity of such discharged air prior to striking such dispersed liquid as it spreads laterally from impingement with said impingement surface.

14. The invention as in claim 13 wherein said air guide surrounds a portion of said supply member adjacent said liquid discharge orifice thereof and includes an internal surface which converges with said supply member in a downstream direction to form an annular flow area which narrows toward said liquid discharge orifice.

15. The invention as in claim 14 wherein said atomizer includes a plurality of air outlet orifices disposed to provide flow of such discharged air, in said air guide, in a substantially complete annulus around said portion of said supply member.

16. The invention as in claim 14 wherein said atomizer includes an annular air outlet orifice disposed to provide flow of such discharged air into said air guide in a substantially complete annulus around said portion of said supply member.

17. The invention as in claim 10 wherein said air outlet orifice or orifices are disposed about said axis in a configuration to discharge a substantially continuous annulus of air around said impingement surface at high velocity and in a direction substantially parallel to said axis to strike the liquid while in such a laterally spreading dispersion adjacent said impingement surface.

18. The invention as in claim 17 wherein said impingement surface is of a first predetermined diameter and said air outlet orifice or orifices form such an annulus of an outer diameter at least as large as said first predetermined diameter.

19. The invention as in claim 18 wherein said annulus outer diameter is greater than said first predetermined diameter.

20. The invention as in claim 10 wherein said impingement element is a pin disposed along said axis and supported by said housing, said pin having an end surface forming said impingement surface.

21. The invention as in claim 10 wherein said impingement surface extends substantially normal to said axis.

22. The invention as in claim 21 wherein said impingement surface is substantially planar.

23. An internal mix pneumatic atomizer for atomizing and spraying liquids into the atmosphere, said atomizer including a supply member having a liquid flow passage which terminates in a liquid discharge orifice for high velocity discharge of a stream of liquid along a predetermined axis, an impingement element having an impingement surface spaced from said discharge orifice and disposed across said axis for breaking up such a stream of liquid impinging thereon into a laterally spreading dispersion of such liquid which thereby is dispersed laterally of said axis from the impingement of such stream on said impingement surface, one or more air outlet orifices disposed around said axis upstream of said impingement surface and oriented to discharge a substantially continuous annulus of air around said liquid discharge orifice in a downstream direction substantially parallel to said axis at high velocity to surround such stream from said liquid discharge orifice to said impingement surface and to strike the liquid while in such a laterally spreading dispersion to further atomize such liquid; and a housing which defines a chamber extending around and downstream of said impingement surface, said housing having a plurality of discharge orifices disposed circumferentially about said impingement surface and communicating directly between said expansion chamber and ambient atmosphere through which the mixture of air and atomized liquid particles resulting from the impingement of such stream on said impingement surface and the striking of such liquid dispersion by such high velocity air is discharged from said chamber.

24. The invention as in claim 23 wherein said housing defines an expansion chamber around and downstream of said impingement surface for expansion therein of the mixture of air and atomized liquid resulting from the impingement of such stream on said impingement surface and the striking of such dispersed liquid by such high velocity air.

25. The invention as in claim 24 wherein said impingement surface is of a first predetermined diameter and said outlet orifice or orifices form such an annulus of air having an outer diameter which is greater than said first predetermined diameter.

26. The invention as in claim 23 including an air guide which defines an internal surface around said axis and which extends downstream from said supply member, said internal surface defining a flow area which decreases in cross-section from said supply member toward said impingement surface for enhancing the velocity of such discharged air prior to striking such dispersed liquid as it spreads laterally from impingement with said impingement surface.

27. The invention as in claim 26 wherein said air guide surrounds a portion of said supply member adjacent said liquid discharge orifice and extends downstream from said liquid discharge orifice, said internal surface around said portion of said supply member converging with said portion in a downstream direction to form an annular flow area which narrows toward the liquid discharge orifice.

28. An internal mix pneumatic atomizer for atomizing and spraying liquids into the atmosphere, said atomizer including a supply member having a liquid flow passage which terminates in a liquid discharge orifice for high velocity discharge of a stream of liquid along a predetermined axis, an impingement element having an impingement surface spaced from said discharge orifice and disposed across said axis for breaking up of a stream of liquid impinging thereon into a laterally spreading dispersion of liquid which is thereby dispersed laterally of said axis from the impingement of the stream on said impingement surface, an air guide which defines an internal surface around said axis and which extends downstream from said supply member, an air supply disposed around said supply member upstream of said air guide and communicating with the upstream end of said air guide to supply air thereinto at high velocity, said internal surface defining a flow area which decreases in cross-section from said liquid discharge orifice toward said impingement surface for enhancing the velocity of such air and discharging such air in a downstream direction substantially parallel to said axis to strike the liquid while in a laterally spreading dispersion to further atomize such liquid particles, a nozzle tip defining an expansion chamber about said impingement element for expansion therein of the mixture of air and atomized liquid particles resulting from the impingement of such stream on said impingement surface and the striking of such dispersed liquid by such high velocity air, said nozzle top having a plurality of discharge orifices disposed circumferentially about said impingement element through which said expanded mixture is discharged from said chamber directly to the atmosphere.

29. The invention as in claim 28 wherein said air supply directs air into said air guide at high velocity in a downstream direction substantially parallel to said axis.

30. The invention as in claim 29 wherein said air supply provides an annulus of such air flow around said supply member adjacent said liquid discharge orifice.

31. The invention as in claim 30 wherein said air supply comprises a plurality of air passages directed into said air guide.

32. An internal mix pneumatic atomizer for atomizing liquids, said atomizer including a supply member having a liquid flow passage which terminates in a liquid discharge orifice for high velocity discharge of a stream of liquid along a predetermined axis, an impingement element having an impingement surface spaced from said discharge orifice and disposed across said axis for breaking up of a stream of liquid impinging thereon into a laterally spreading dispersion of liquid which is thereby dispersed laterally of said axis from the impingement of the stream on said impingement surface, an air guide which defines an internal surface around said axis and which extends downstream from said supply member, air supply means disposed around said supply member upstream of said air guide and communicating with the upstream end of said air guide to supply air thereinto at high velocity, said air supply means defining an annulus for air flow around the supply member adjacent said liquid discharge orifice which has an annular outlet orifice for directing air into said air guide at a high velocity in a downstream direction substantially parallel to said axis, and said internal surface defining a flow area which decreases in cross-section from said liquid discharge orifice toward said impingement surface for enhancing the velocity of such air and discharging such air in a downstream direction substantially parallel to said axis to strike the liquid while in a laterally spreading dispersion to further atomize such liquid particles.

* * * * *